United States Patent [19]

Stewen et al.

[11] Patent Number: 4,502,922

[45] Date of Patent: Mar. 5, 1985

[54] COKE OVEN CHAMBER DOOR

[76] Inventors: Wilhelm Stewen, Gibbenhey 8, 4600 Dortmund 50; Peter Pape, Ringstr. 26, 4200 Oberhausen, both of Fed. Rep. of Germany

[21] Appl. No.: 537,404

[22] PCT Filed: Jan. 15, 1983

[86] PCT No.: PCT/DE83/00004

§ 371 Date: Sep. 15, 1983

§ 102(e) Date: Sep. 15, 1983

[87] PCT Pub. No.: WO83/02454

PCT Pub. Date: Jul. 21, 1983

[51] Int. Cl.[3] ..... C10B 25/06; C10B 29/04

[52] U.S. Cl. ..... 202/248; 202/268

[58] Field of Search ..... 202/248, 268; 110/173 R

[56] References Cited

U.S. PATENT DOCUMENTS

| | | | |
|---|---|---|---|
| 4,086,145 | 4/1978 | Muller | 110/173 R |
| 4,217,177 | 8/1980 | Gerding et al. | 202/248 |
| 4,366,028 | 12/1982 | Abendroth | 202/248 |
| 4,381,972 | 5/1983 | Stog | 202/248 |
| 4,414,072 | 11/1983 | Breidenbach et al. | 202/248 |

FOREIGN PATENT DOCUMENTS

| | | | |
|---|---|---|---|
| 0028679 | 5/1981 | European Pat. Off. | 202/248 |
| 0058320 | 8/1982 | European Pat. Off. | 202/248 |
| 3000161 | 7/1981 | Fed. Rep. of Germany . | |
| 3105703 | 6/1982 | Fed. Rep. of Germany | 202/248 |

*Primary Examiner*—Bradley Garris

*Attorney, Agent, or Firm*—Thomas H. Murray; Clifford A. Poff

[57] ABSTRACT

Coke oven chamber doors form heat-resistant plugs having a construction to prevent damage when the plugs are removed and replaced. Each plug consists of an external door-body plate and internal steel plates. The ends of the internal plates overlap each other for relative movement. The lowermost plate is secured at its lower end and the uppermost plate is secured at its upper end. This provides a specific longitudinal dimension of the overlapping plates.

5 Claims, 7 Drawing Figures

COKE OVEN CHAMBER DOOR

BACKGROUND OF THE INVENTION

This invention relates to a door for a coke oven chamber and more particularly, to such a door forming a heat-resistant plug consisting of a door-body plate external to the oven chamber and steel plates extending in the oven chamber and arranged with one end displaceable for heat-insulating purposes.

Doors of this type are particularly useful for coke ovens having walls provided with heating flues which, in contrast to the design of reverberatory furnaces with a quenched furnace charge and having first heating flues set back in the furnace walls, comprise heating flues which are set forwardly in the heating walls and mechanical leveling of the charge in the furnace takes place. The chamber doors for coke ovens provide flameproof plugs which serve to reduce the release of heat to the outside from the door plates, usually made of cast iron, to such an extent that the door body structure will not bend. The chamber doors also reduce preheating stresses due to the forward, first heating flues on the oven parts, namely on the oven heads and particularly on the buckstays located in the area of the first heating flue by maintaining the glowing coke sufficiently faraway from the area.

In known door designs for coke ovens of this type, the plug consists of refractory material which, for example, may be in the form of brickwork resting on a lower brickholder and secured by lateral brickholders to the door or in the form of molded brick which is, for example, bolted to the door-body plate. The first heating flue in the wall of the coking chamber is usually located behind outwardly-directed brickwork preferably made of slightly acidic brick and supported outside the furnace by a layer of heat-insulating material upon buckstays. The door frame is carried by brickwork that is usually interchangeable. When the door is closed, the inside of the fireproof plug material projects into the oven chamber to the first heating flue. This protects the door seal from the heat of the first heating flue and the heat of the coke cake. To accelerate carbonization of the coal charge in the head parts of the coke oven, and thus obtaining uniform coking of the coal charge, it has been proposed as disclosed by West German patent publication No. OS 30 00 161, to provide the furnace side of the plug with a coating having a degree of heat conductivity which is greater than the material of the plug. The overall dimension of the door plug is reduced by the thickness of the coating so that the coating does not change the overall dimension of the door plug.

Thermal expansion of the coating, arising during the coking process, may be compensated for by the use of metal plates arranged as a covering. In this way, the supporting surface of the door plug becomes the heating surface and brings about better carbonization of the top part of the coal charge in the oven chamber. An air or gas chamber may be formed between the door plug and the steel plates. The low heat conductivity of the enclosed air or gas in this chamber may be used, outstandingly, for heat insulation. The distance between the door body and the steel plates may be varied according to the permissible surface temperature of the door body. According to a known design, the steel plates have T-shaped stiffeners. The plates are arranged with their ends overlapping each other in the downward direction. The lower ends of the plates can expand freely. When the height of a coke oven chamber is 4 meters, the steel plates should be no longer than 1 meter. As the height of the coke oven chamber increases, the length of the steel plates is decreased to one-tenth of the oven chamber height. Thus, when the height of an oven chamber is 7 meters, the length of the steel plates is 0.7 meter at most. As a result of reoccurring problems, the operational reliability of this door design is far lower than that of conventional door plugs. Damage to the door plug is concentrated in the lower part of the plates.

SUMMARY OF THE INVENTION

It is the purpose of the present invention to adapt such door plugs for the rugged operations occurring in coking plants. The invention is based on the concept that the cause of various kinds of damage to the door plugs is when the doors are removed especially in a manually-operated cycle, they are partially withdrawn and then lowered. The lowermost steel plate, therefore, rests upon the base. The entire weight of the door rests upon the steel plate which, with its mounting, suffers considerable deformation. As the door-removal operation proceeds, the door is moved forwardly. This allows the lowermost plate to grind over the base to the frame of the door which is at a higher level than the base. As a result, the lowermost plate is bent forwardly and torn from its mounting. According to the present invention, damage of this type is eliminated by providing that thermal expansion of the lowermost steel plate is directed upwardly, i.e., in contrast to the other steel plates. Thus, the lowermost steel plate has a fixed point at its lower end while the upper end of the plate is mounted displaceably to allow for thermal expansion. As a result, there is always a specific, constant height of the steel plates forming the door plug at any degree of thermal expansion.

Another advantage of this plate arrangement can be found in the dual-function of the upper mounting for the steel plate. According to the known concept, this mounting constituted a longitudinally-displaceable bearing for the steel plate lying above the mounting. However, according to the present invention, the mounting also constitutes a longitudinally-displaceable bearing for the lowermost steel plate.

According to the present invention, a common displaceable bearing is provided for each of two adjacent steel plates. The ends of the plates remote from the displaceable bearing have common mountings such that two steel plates are locked to each of the mountings. The uppermost steel plate on the oven door is arranged, if necessary, by using separate mountings and displaceable bearings in such a manner that the end of the steel plate located at the upper end of the door is locked. Thermal expansion of the steel plate, or the change in length associated therewith, is directed downwardly. All of the steel plates are arranged in such a manner that the lower end of an upper plate overlaps the lower end of an underlying plate.

The dimension of the door is specific at each temperature and protection against damage is increased by an extension to the doorholder in accordance with the distance between the door body and the steel plates. This extension is preferably in the form of a U-shaped section with a plate thereunder. The underside thereof also being provided with a slipper.

These features and advantages of the present invention as well as others will be more fully understood when the following description of the state-of-the-art upon which the invention is based and an example of an embodiment of the invention are read in light of the accompanying drawings, wherein.

Figure 1:
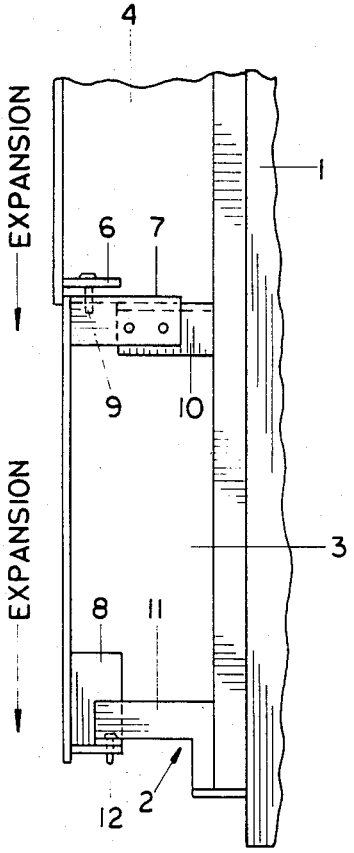
FIG. 1 PRIOR ART
FIG. 1 is a side elevational view of a door body according to an existing or known design.
Figure 2:
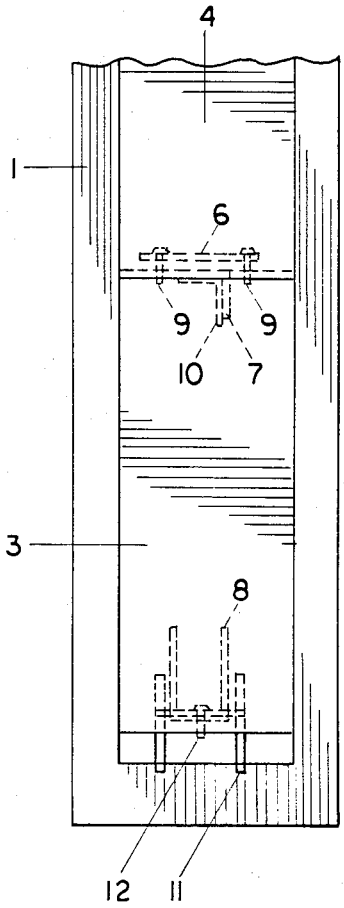
FIG. 2 PRIOR ART
FIG. 2 is a front elevational view of the door body shown in FIG. 1.
Figure 3:
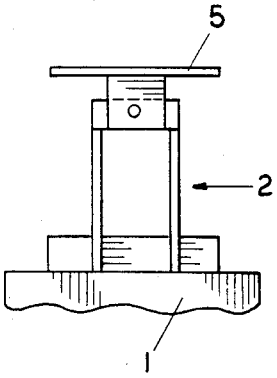
FIG. 3 PRIOR ART
FIG. 3 is a bottom plan view of the door body shown in FIG. 1.

According to the known coke oven chamber door shown in FIGS. 1-3, the door includes a door body 1 that carries a plug 2. When in operation, the chamber door closes off an interchangeable door frame of the coke oven chamber. The door frame is generally located in the upper parts of coke oven chamber walls which are provided with heating flues. When in operation, the plug 2 of the chamber door projects into the coke oven chamber; whereas the door body 1 bears externally of the coke oven chamber against the door frame. Adequate sealing is provided by means of sealing elements, not shown, between the door frame and the door body. The sealing elements are in the form of steel sections, for example. Plug 2, being a hollow body, acts as a gas-collecting chamber through which gases produced during the coking process pass to a gas-collecting chamber arranged in the head of the coke oven or to a riser pipe in the vicinity of the coke oven roof. Plug 2 consists of a plurality of sections which, as shown in FIGS. 1 and 2, comprises sections 3 and 4. Each section 3 or 4 comprises a steel plate 5. The steel plates overlap from top to bottom so that the lower end of the upper plate 5 overlaps the upper end of the lower plate 5.

Each of the steel plates is fitted with lugs. The lugs at the upper ends of the plates are used to lock or anchor the end of the steel plate associated therewith; whereas the lugs at the lower ends of the plates provide longitudinally-displaceable bearings to allow for thermal expansion of the plates. The lug or section 4 at the lower end of the steel plate is identified by reference numeral 6 and the lug at the upper end of section 3 is identified by reference numeral 7. The lug at the lower end of section 3 is identified by reference numeral 8. Pins 9 guide the lug 6 which is displaceable in relation to lug 7. A section or distance sufficient for thermal expansion of steel plate 5 of section 4 exists between lugs 6 and 7. Lug 7 is located on a bracket 10 secured to the door body 1. Illustrated diagrammatically is a pin or threaded connection between bracket 10 and lug 7. The pin or threaded connection secures the upper end of section 3 to the door body. The same arrangement exists at the upper end of section 4. A bracket 11 forms a bearing for longitudinal expansion of the lower end of section 4. Bracket 11 is secured to the door frame. A pin 12 arranged displaceably in lug 8 guides the lower end of section 3 from the bracket 11.

The cavity existing between steel plate 5 and the door body 1 constitutes a vertical gas-collecting chamber through which gaseous products from the coking process may, with advantage, pass to the upper gas-collecting chamber and the riser pipe. Due to the resulting favorable gas pressure conditions, the gas pressure at the joint between the door frame and the door, in relation to the pressure of the outside air, is so favorable that emissions from the coke oven doors can be prevented with conventional sealing elements. Heat is supplied or distributed by the steel plates 5 which have a high thermal conductivity so that it is possible to permit the plates to project 100 millimeters less into the oven chamber which is equivalent to increasing the useful capacity of the coke oven while maintaining constant coking of the head parts in the oven chambers.

Figure 4:
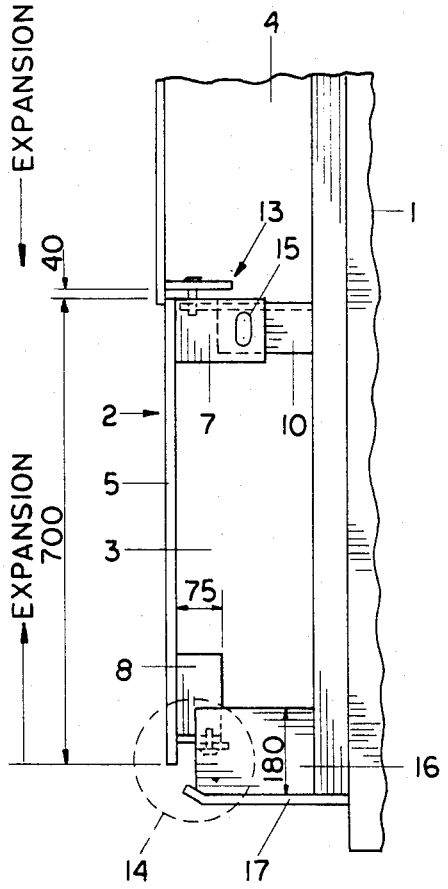
FIG. 4 is a side elevational view of a door body according to the present invention.
Figure 5:
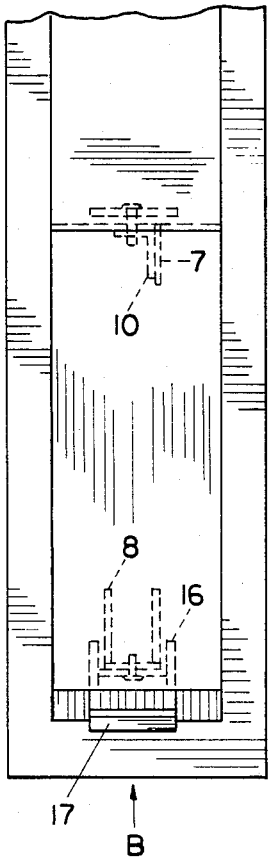
FIG. 5 is a front elevational view of the door body shown in FIG. 4.
Figure 6:
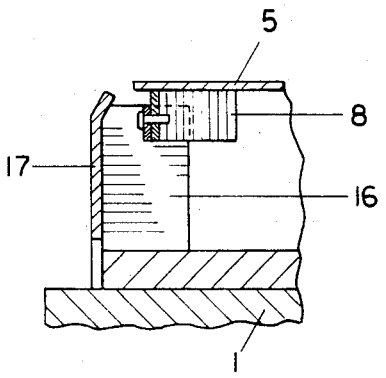
FIG. 6 is a sectional view taken along line A—A of FIG. 7.
Figure 7:
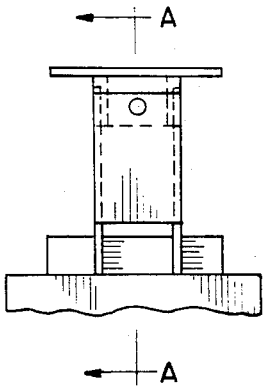
FIG. 7 is a bottom plan view in the direction of line B in FIG. 5 showing the door illustrated in FIGS. 4 and 5.

The coke oven chamber door according to the present invention as shown in FIGS. 4-7 differs from the chamber door shown in FIGS. 1-3 and as just described by providing a different suspension for sections 3 and 4 in a connecting area 13 and by a different arrangement at the base of the plug 2 which is at an area identified by reference numeral 14 in FIG. 4. Lug 7 at the joint with bracket 10 is provided with an elongated hole 15 to permit thermal expansion of steel plate 5 in a longitudinal direction of the door within the framework of section 3. The connection between lug 7 and bracket 10 is formed by means of a pin illustrated diagrammatically. The pin is arranged in bracket 10 and slides in the elongated hole 15.

In the area 14, the lower end of section 3 is secured by lug 8 to a bracket 16. Bracket 16 extends substantially as far as steel plate 5 in section 3 and is provided with a slipper 17 on the underside of the bracket 16. Thermal expansion of the lowermost steel plate 5 is directed upwardly by the design according to the present invention as identified by the labeled arrow in FIG. 4. This establishes a definite fixed point for the dimensions of the plug as a whole and the underlying doorholder. The lower end of section 3 is reinforced by the bracket 16 and is also protected from damage by the slipper 17. This insures that when the door is replaced, there can be no damage to the structure of the door, the frame or the base brick regardless of the method of operation of the door-operating machines.

Although the invention has been shown in connection with a certain specific embodiment, it will be readily apparent to those skilled in the art that various changes in form and arrangement of parts may be made to suit requirements without departing from the spirit and scope of the invention.

We claim as our invention:

1. A coke oven chamber door comprising a fireproof plug and a door-body plate, said fireproof plug including a plurality of steel plates with an upper and a lower steel plate having end portions overlapping one another in the longitudinal direction of the plug, said upper steel plate being supported for displacement only in a downward direction in response to thermal expansion thereof, and means supported by said door-body plate for carrying the lower end of said lower steel plate in a stationary manner such that the end thereof lying thereabove is only displaceable upwardly in response to thermal expansion to maintain a constant height of said steel plates on said door-body plate.

2. A coke oven chamber door according to claim 1 further comprising a bearing support carried by said door-body plate above said means, said bearing support including displaceable bearing parts each for one of two overlapping end portions of said steel plates.

3. A coke oven chamber door according to claim 2 wherein said bearing support further includes a stationary bracket for supporting said displaceable bearing parts.

4. A coke oven chamber door according to claim 1 wherein said means includes a slipper at the lower end of the plug.

5. A coke oven chamber door according to claim 4 wherein said means further includes a bracket for supporting said slipper at a spaced location below the lower end of said lower steel plate.

* * * * *